US009034549B2

(12) United States Patent
Shiotari et al.

(10) Patent No.: US 9,034,549 B2
(45) Date of Patent: May 19, 2015

(54) TONER

(75) Inventors: Yoshiaki Shiotari, Mishima (JP); Hiroyuki Fujikawa, Yokohama (JP); Kunihiko Nakamura, Gotemba (JP); Nozomu Komatsu, Toride (JP); Kosuke Fukudome, Tokyo (JP); Takayuki Itakura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/995,499

(22) PCT Filed: Dec. 9, 2011

(86) PCT No.: PCT/JP2011/079117

§ 371 (c)(1), (2), (4) Date: Jun. 18, 2013

(87) PCT Pub. No.: WO2012/086524

PCT Pub. Date: Jun. 28, 2012

(65) Prior Publication Data

US 2013/0288174 A1 Oct. 31, 2013

(30) Foreign Application Priority Data

Dec. 24, 2010 (JP) ..... 2010-288429

(51) Int. Cl.

*G03G 9/087* (2006.01)
*G03G 9/08* (2006.01)
*G03G 9/097* (2006.01)

(52) U.S. Cl.

CPC ..... *G03G 9/08755* (2013.01); *G03G 9/0804* (2013.01); *G03G 9/0812* (2013.01); *G03G 9/0815* (2013.01); *G03G 9/09716* (2013.01); *G03G 9/09783* (2013.01)

(58) Field of Classification Search

CPC ..... G03G 9/09783; G03G 9/09716; G03G 9/09725; G03G 9/08755; G03G 9/08797; G03G 9/08795

USPC ..... 430/108.3, 109.4

See application file for complete search history.

(56) References Cited

U.S. PATENT DOCUMENTS 5,968,701 A 10/1999 Onuma et al.
6,020,102 A 2/2000 Fujimoto et al.

(Continued)

FOREIGN PATENT DOCUMENTS

JP 5-127416 A 5/1993
JP 8-30016 A 2/1996

(Continued)

OTHER PUBLICATIONS

PCT International Search Report and Written Opinion of the International Searching Authority, International Application No. JP2011/079117, Mailing Date Jan. 17, 2012.

(Continued)

*Primary Examiner* — Hoa V Le

(74) *Attorney, Agent, or Firm* — Fitzpatrick, Cella, Harper and Scinto

(57) ABSTRACT

A toner is provided that exhibits a satisfactory heat-resistant storability and an excellent low-temperature fixability. The toner has toner particles each of which contains at least a binder resin and a wax, and is characterized in that this toner is obtained by attaching a metal compound to the surface of the toner particle and thereafter performing a surface treatment with a hot air current; the binder resin contains at least a polyester resin; and the metal compound is formed by coordinating or bonding a specific aromatic oxycarboxylic acid to a metal.

5 Claims, 2 Drawing Sheets

(56) References Cited

U.S. PATENT DOCUMENTS

| | | | |
|---|---|---|---|
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,653,036 | B1 | 11/2003 | Tanikawa et al. |
| 6,664,016 | B2 | 12/2003 | Kanbayashi et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 6,905,808 | B2 | 6/2005 | Itakura et al. |
| 6,929,894 | B2 | 8/2005 | Sugahara et al. |
| 7,022,449 | B2 | 4/2006 | Sugahara et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,767,370 | B2 | 8/2010 | Ishigami et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,067,477 | B2 | 11/2011 | Hirota et al. |
| 8,114,562 | B2 | 2/2012 | Ishigami et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,323,726 | B2 | 12/2012 | Naka et al. |
| 2006/0127788 | A1* | 6/2006 | Yamashita et al. ..... 430/109.1 |
| 2006/0154168 | A1* | 7/2006 | Tomita et al. ..... 430/109.4 |
| 2007/0286652 | A1* | 12/2007 | Suzuki et al. ..... 399/338 |
| 2008/0138132 | A1* | 6/2008 | Yamashita et al. ..... 399/343 |
| 2009/0098475 | A1 | 4/2009 | Yamada et al. |
| 2009/0220879 | A1* | 9/2009 | Matsumoto et al. ..... 430/108.1 |
| 2010/0183971 | A1 | 7/2010 | Fujikawa et al. |
| 2010/0227265 | A1* | 9/2010 | Matsumoto et al. ..... 430/105 |
| 2010/0248126 | A1 | 9/2010 | Ishigami et al. |
| 2011/0097661 | A1 | 4/2011 | Ishigami et al. |
| 2013/0171556 | A1 | 7/2013 | Fujikawa et al. |
| 2013/0244159 | A1 | 9/2013 | Ishigami et al. |
| 2013/0244164 | A1 | 9/2013 | Fujikawa et al. |
| 2013/0288173 | A1 | 10/2013 | Hashimoto et al. |
| 2013/0316282 | A1 | 11/2013 | Ishigami et al. |

FOREIGN PATENT DOCUMENTS

| | | | |
|---|---|---|---|
| JP | 2002-148868 | A | 5/2002 |
| JP | 2002-372832 | A | 12/2002 |
| JP | 2004-226580 | A | 8/2004 |
| JP | 2004-271685 | A | 9/2004 |
| JP | 2006-163438 | A | 6/2006 |
| JP | 2009-93088 | A | 4/2009 |
| TW | 2009-37147 | A | 9/2009 |

OTHER PUBLICATIONS

Taiwanese Office Action dated Jan. 21, 2014 in Taiwanese Application No. 100148373.

Komatsu, et al., U.S. Appl. No. 13/902,365, filed May 24, 2013.

Terauchi, et al., U.S. Appl. No. 13/922,205, filed Jun. 19, 2013.

* cited by examiner

TONER

TECHNICAL FIELD

The present invention relates to a toner that is used in electrophotographic systems, electrostatic recording systems, electrostatic printing systems, and toner jet systems.

BACKGROUND ART

The widespread use of full-color copiers that employ electrophotographic systems in recent years has been accompanied by increased demands for energy-saving measures. As a specific energy-saving measure, investigations have been carried out into technology that brings about fixing at lower fixation temperatures in order to lower the power consumption in the fixing step.

One strategy for achieving this is to lower the glass transition temperature (Tg) of the toner. However, when just a lowering of the Tg is implemented by itself, the heat-resistant storability of the toner is lowered and clumping is then prone to appear in high temperature environments due to the occurrence of aggregation between toner particles in contact with each other. The heat-resistant storability of the toner must therefore be improved in order to pursue improvements in the low-temperature fixability.

In response to this problem, various efforts at producing a toner having a capsule structure have been proposed. For example, improving the heat-resistant storability has been pursued by coating the surface of a core particle comprising a low Tg resin with the fine powder of a resin having a higher Tg than that of the core particle and then forming a surface coat layer of the fine resin powder by performing a surface treatment with a hot air current (refer to Patent Document 1).

However, while the toner described in Patent Document 1 does have an improved heat-resistant storability, the surface of the toner particle is nevertheless coated with the fine powder of a high Tg resin, and as a consequence the low-temperature fixability possessed by the core particle of the toner cannot be thoroughly manifested, for example, in high-speed equipment (high-speed equipment operating at 80 prints/minute or more), and a large energy consumption may then be required for fixing.

CITATION LIST

Patent Document

[Patent Document 1] Japanese Patent Application Laid-open No. 2002-148868

DISCLOSURE OF THE INVENTION

The present invention provides a toner that solves the problem described above. Specifically, the present invention provides a toner with a satisfactory heat-resistant storability and an excellent low-temperature fixability.

As a result of intensive and extensive investigations, the present inventors discovered a toner that has a satisfactory heat-resistant storability and can satisfactorily manifest low-temperature fixability. That is, the present invention is as described below.

The present invention relates to a toner having toner particles containing a binder resin and a wax, the toner being characterized in that the toner is obtained by attaching a metal compound to a toner particle surface and thereafter performing a surface treatment with a hot air current;

the binder resin contains a polyester resin; and the metal compound is a metal compound formed by coordinating or bonding an aromatic oxycarboxylic acid represented by general formula (1) below to a metal:

[Chem 1]

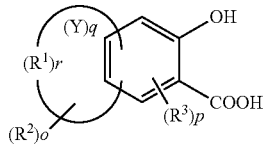

(1)

where, $R^1$ represents a quaternary carbon, methine, or methylene, each of which may contain N, S, O, or P atom, Y represents a cyclic structure bonded by a saturated bond or an unsaturated bond, and $R^2$ and $R^3$ each independently represents an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may also be substituted by a substituent; r is 0 or an integer from 3 to 12, o is 0 or an integer from 1 to 8, p is 0 or an integer from 1 to 4, and q is 0 or an integer from 1 to 3.

The present invention can provide a toner that has a satisfactory heat-resistant storability and can satisfactorily manifest low-temperature fixability.

MODE FOR CARRYING OUT THE INVENTION

Figure 1:
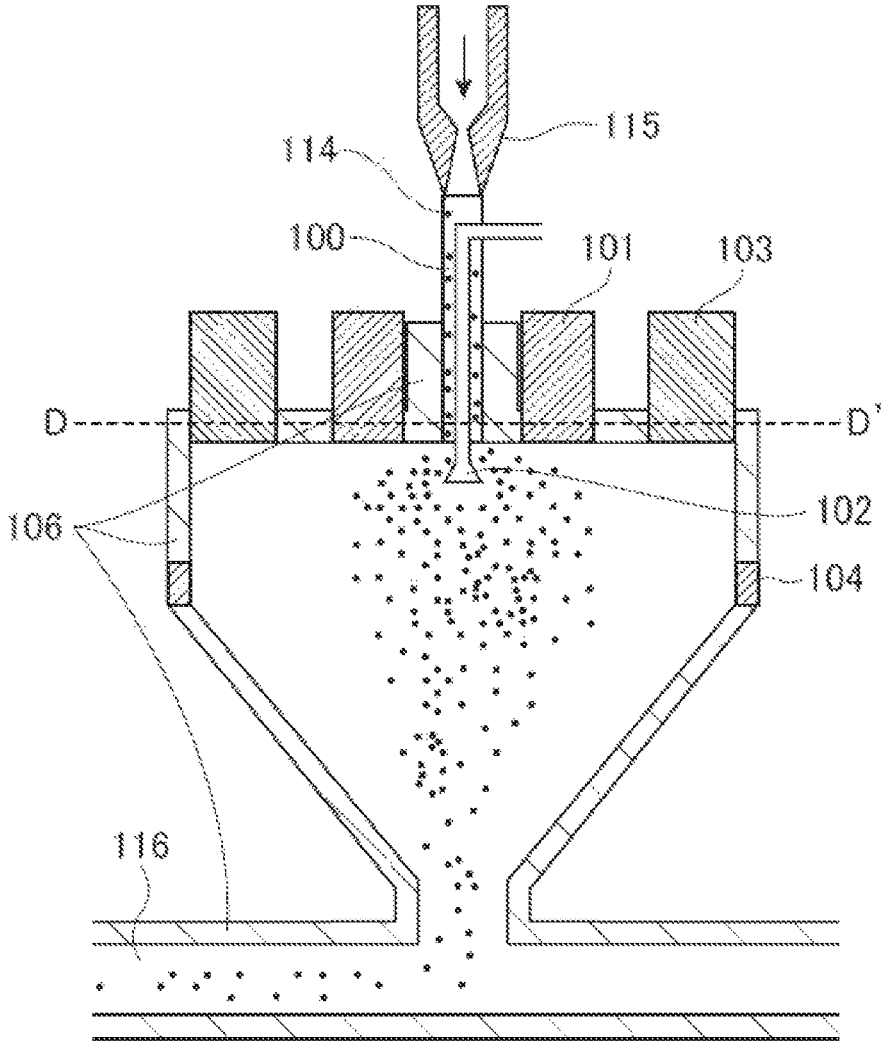
FIG. 1 is a schematic sectional view of an apparatus for treating the surface of toner particles.

Modes for carrying out the present invention are described in detail in the following.

The toner of the present invention is a toner having toner particles, each of which contains at least a binder resin and a wax, wherein, the toner is obtained by attaching a metal compound to a toner particle surface and thereafter performing a surface treatment with a hot air current;

the binder resin contains at least a polyester resin; and the metal compound is a metal compound formed by coordinating or bonding an aromatic oxycarboxylic acid represented by general formula (1) below to a metal:

[Chem 2]

(1)

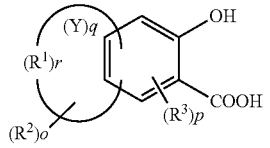

where, $R^1$ represents a quaternary carbon, methine, or methylene, each of which may contain N, S, O, or P atom, Y represents a cyclic structure bonded by a saturated bond or an unsaturated bond, $R^2$ and $R^3$ each independently represents an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may also be substituted by a substituent; r is 0 or an integer from 3 to 12, o is 0 or an integer from 1 to 8, p is 0 or an integer from 1 to 4, and q is 0 or an integer from 1 to 3.

In the Specification of the present application, the alkyl group preferably has from 1 to 18 carbons. The alkyl group and can be exemplified by methyl, ethyl, propyl, isopropyl, butyl, isobutyl, sec-butyl, tert-butyl, pentyl, isopentyl, neopentyl, hexyl, heptyl, octyl, nonyl, decyl, undecyl, and dodecyl groups.

The aryl group can be exemplified by phenyl, tolyl, xylyl, styryl, naphthyl, anthryl, and biphenyl groups.

The aralkyl group can be exemplified by benzyl, phenylethyl, and phenylpropyl groups.

The cycloalkyl group can be exemplified by cyclopropyl, cyclobutyl, cyclopentyl, cyclohexyl, cycloheptyl, cyclooctyl, and cyclononyl groups.

The alkenyl group can be exemplified by vinyl, allyl, propenyl, isopropenyl, butenyl, hexenyl, cyclohexenyl, and octenyl groups.

The alkoxyl group can be exemplified by methoxy, ethoxy, butoxy, propioxy, hexyloxy, cyclohexyloxy, heptyloxy, octyloxy, tertiary-octyloxy, 2-ethylhexyloxy, decyloxy, dodecyloxy, and octadecyloxy groups.

The aryloxy group can be exemplified by phenyloxy, naphthyloxy, and anthranyloxy groups.

The acyloxy group and alkoxycarbonyl group can be exemplified by the formyloxy group, methoxycarbonyl (acetyloxy) group ($CH_3COO$—), ethoxycarbonyl group ($C_2H_5COO$—), propionyloxy group, hexanoyloxy group, octanoyloxy group, and lauroyloxy group.

The substituent that may be additionally substituted on the substituents represented by $R^2$ and $R^3$ can be exemplified by halogen atoms, the nitro group, the cyano group, alkyl groups such as methyl and ethyl groups, alkoxyl groups such as methoxy and ethoxy groups, aryloxy groups such as phenoxy group, aryl groups such as phenyl and naphthyl groups, and aralkyl groups.

The cyclic structure represented by Y can be exemplified by an aliphatic ring, aromatic ring, and heterocyclic ring.

The toner according to the present invention has a satisfactory heat-resistant storability and can fully manifest the low-temperature fixability possessed by the binder resin. While the reason for this is unclear, the following can be conjectured.

Figure 2:
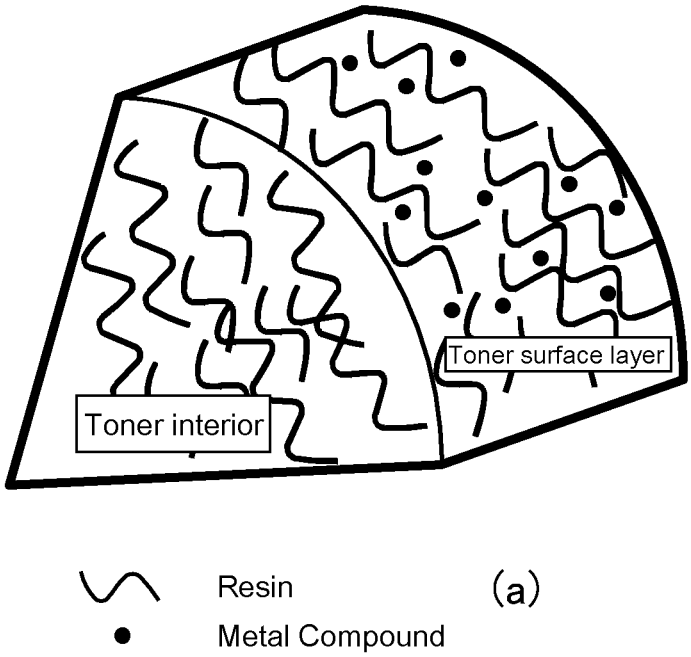
FIG. 2 is a conceptual drawing of the surface of the toner particle, wherein FIG. 2(*a*) refers to before surface treatment and FIG. 2(*b*) refers to after surface treatment.
Figure 2:
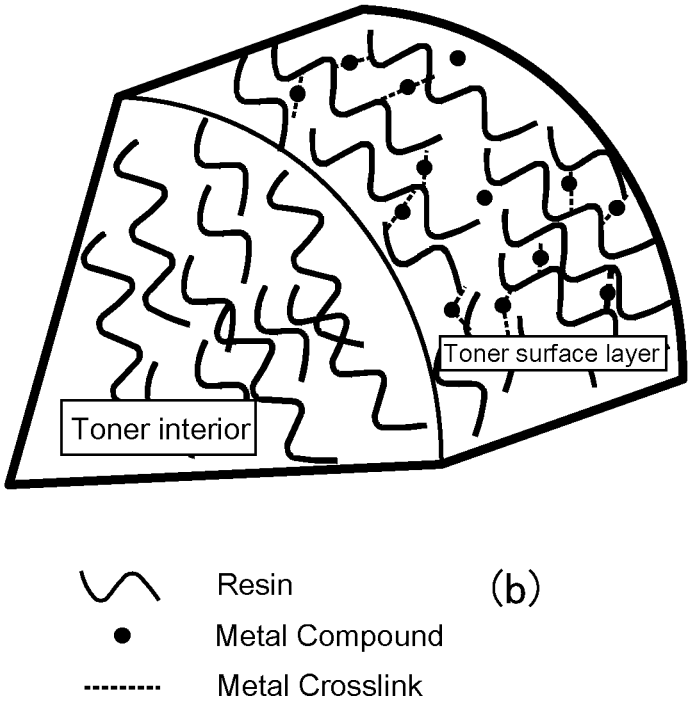

The metal compound is first attached to the surface of the toner particle ((*a*) in FIG. 2). The metal compound-bearing toner particle is then introduced into an atmosphere having a hot air current. When the toner particle passes through this hot air current atmosphere, the constituent materials of the toner particle, e.g., resin, wax, and so forth, that are present on the surface of the toner particle are softened by the hot air current. The softened constituent materials of the toner particle act so as to lower the surface energy of the toner particle surface, and as a consequence the toner particle begins to be a spherical shape with its smaller surface area. When the metal compound used by the present invention is present at the toner particle surface, the softened resin and this metal compound undergo mixing when the toner particle begins to be a spherical shape, and the ligand in the metal compound undergoes ligand exchange with a polar group in the resin to produce a metal crosslinking reaction in the resin ((*b*) in FIG. 2). Once the toner particle has passed through the hot air current atmosphere, the toner particle surface is cooled with the resin having undergone metal crosslinking with itself and the toner particle surface layer forms a crosslinked structure due to the metal crosslinking. As a result, the heat-resistant storability is believed to be improved due to a greater inhibition of molecular motion in the crosslinked toner particle surface layer in a high temperature environment than for the interior of the toner particle.

Moreover, it is thought that the binder resin does not lose its native low-temperature fixability because this metal crosslinking is carried out only in the surfacemost layer of the toner particle.

It is crucial in the present invention that the binder resin contain a polyester resin. This is thought to be due to the ease with which the carbonyl group, ester group, hydroxyl group, and so forth present in a polyester resin undergo metal crosslinking with the metal compound.

It is also crucial that the metal compound used in the present invention be a metal compound in which the aromatic oxycarboxylic acid represented by general formula (1) is coordinated or bonded.

It is thought that an additional improvement in the heat-resistant storability is obtained with the aromatic oxycarboxylic acid represented by general formula (1) because metal crosslinking proceeds efficiently at the toner particle surface due to facile mixing between this aromatic oxycarboxylic acid and the polyester resin when the polyester resin is melted in the hot air current atmosphere. It is further thought that the durability is also improved due to the addition to the toner particle of the large amount of charge originating with the aromatic oxycarboxylic acid.

The metal in the metal compound used by the present invention is preferably at least one metal selected from the group consisting of Al, Cr, Zn, and Zr.

The use of a metal compound in which the above-described metal is coordinated or bonded with the above-described aromatic oxycarboxylic acid not only provides an excellent low-temperature fixability, offset resistance, and heat-resistant storability, but also provides an excellent durability because a large amount of charge can then be acquired.

The content of the metal compound used by the present invention, expressed with reference to the toner particle, is preferably in a range from 0.2 mass % to 4.0 mass % and more preferably in a range from 0.5 mass % to 3.0 mass %. A metal compound content in this range is preferred because this enables the heat-resistant storability to be improved without impairing the low-temperature fixability.

The metal compound used in the present invention is a metal compound provided by coordinating or bonding an aromatic oxycarboxylic acid represented by general formula (1) with a metal, but is not otherwise particularly limited.

Compounds with the following formulae (2) to (4) are favorable specific examples of the metal compound used by the present invention.

[Chem 3]

(2)

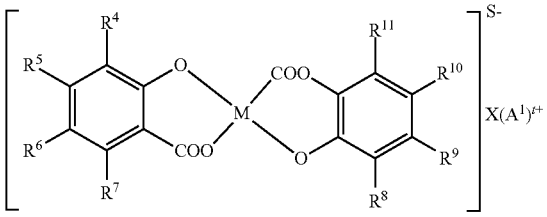

$R^4$ to $R^{11}$ in formula (2) each independently represents hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent. $R^4$ and $R^5$, or $R^5$ and $R^6$, or $R^6$ and $R^7$, or $R^8$ and $R^9$, or $R^9$ and $R^{10}$, or $R^{10}$ and $R^{11}$ may be bonded to form an aromatic ring, which may also have a substituent.

M represents a metal selected from the group consisting of Al, Cr, Zn, and Zr; s represents 0, 1, or 2; t represents 1 or 2; $(A^1)^{t+}$ represents $H^+$, $NH_4^+$, an alkali metal-based cation, an organic amine-based cation, or a quaternary organoammonium ion; and X represents 0, 1, or 2.

[Chem 4]

(3)

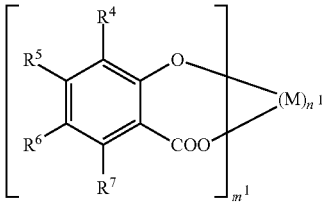

$R^4$ to $R^7$ in formula (3) each independently represent hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent. $R^4$ and $R^5$, or $R^5$ and $R^6$, or $R^6$ and $R^7$ may be bonded to form an aromatic ring, which may also have a substituent.

M represents a metal selected from the group consisting of Al, Cr, Zn, and Zr; $m^1$ represents an integer greater than or equal to 3; and $n^1$ represents an integer greater than or equal to 1.

[Chem 5]

(4)

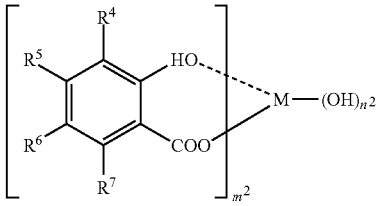

$R^4$ to $R^7$ in formula (4) each independently represents hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent. $R^4$ and $R^5$, or $R^5$ and $R^6$, or $R^6$ and $R^7$ may be bonded to form an aromatic ring, which may also have a substituent.

M represents a metal selected from the group consisting of Al, Cr, Zn, and Zr, and $m^2$ and $n^2$ each represent a positive integer.

According to the results of intensive investigations by the present inventors, the hydroxyl value of the binder resin used in the present invention, and in particular the hydroxyl value of the polyester resin, is preferably in a range from 10 mg KOH/g to 80 mg KOH/g. A hydroxyl value ranging from 25 mg KOH/g to 70 mg KOH/g is more preferred. The reason for this is believed to be generally as follows.

The ligand exchange reaction between the polyester resin and metal compound is thought to proceed mainly with the terminal hydroxyl group of the polyester resin and the ester bond moiety that is a structural element of the polyester resin. As a consequence, when the hydroxyl value is in the above-described range, the hydroxyl group is present at both terminals of the polyester resin and it is thought that a crosslinked structure is then built up by metal crosslinking due to a ligand exchange reaction between the metal compound ligand and the hydroxyl groups at both terminals of the polyester resin and the ester bond moiety of the polyester resin.

The binder resin used in the present invention may also be a mixture of a plurality of polyester resins having different molecular weight distributions.

A difunctional or trifunctional or higher functional alcohol and a difunctional or trifunctional or higher functional carboxylic acid component, e.g., a carboxylic acid, carboxylic acid anhydride, or carboxylic acid ester, are used as the constituent monomer units of the polyester resin used in the present invention.

The difunctional alcohol can be exemplified by the following: alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)polyoxyethylene(2.0)-2,2-bis(4-hydroxyphenyl) propane, polyoxypropylene(6)-2,2-bis(4-hydroxyphenyl) propane, and so forth, as well as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts on bisphenol A, ethylene adducts on bisphenol A, hydrogenated bisphenol A, and so forth.

The trifunctional and higher functional alcohols can be exemplified by sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and so forth. Among the preceding alcohols, the use is preferred of polyoxypropylene(2.2)-2,2-bis (4-hydroxyphenyl)propane and polyoxyethylene(2.0)-2,2-bis (4-hydroxyphenyl)propane. A single monomer or a plurality of monomers selected from these difunctional alcohol monomers and trifunctional and higher functional polyhydric alcohol monomers may be used.

The acid component can be exemplified by difunctional carboxylic acid component monomers such as maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and the anhydrides and lower alkyl esters of the preceding acids. Among these difunctional carboxylic acid components, the use is preferred of maleic acid, fumaric acid, terephthalic acid, isododecenylsuccinic acid, and the anhydrides and lower alkyl esters of these acids.

The trifunctional and higher functional carboxylic acid components can be exemplified by 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acids, and the anhydrides and lower alkyl esters of the preceding. A single monomer or a plurality of monomers selected from these difunctional carboxylic acid monomers and trifunctional and higher functional polybasic carboxylic acid monomers may be used.

The following polymers, for example, can also be added as the binder resin used in the toner of the present invention: homopolymers of styrene and substituted styrenes, e.g., polystyrene, poly-p-chlorostyrene, and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, and styrene-acrylonitrile-indene copolymer; as well as polyvinyl chloride, phenolic resins, naturally modified phenolic resins, natural resin-modified maleic acid resins, acrylic resins, methacrylic resins, polyvinyl acetate, silicone resins, polyester resins, polyurethane, polyamide resins, furan resins, epoxy resins, xylene resins, polyvinyl butyral, terpene resins, coumarone-indene resins, and petroleum resins.

The wax used in the toner of the present invention can be exemplified by the following:

hydrocarbon waxes such as low molecular weight polyethylene, low molecular weight polypropylene, alkylene copolymers, microcrystalline wax, paraffin wax, and Fischer-Tropsch waxes; oxides of hydrocarbon waxes, such as oxidized polyethylene wax, and their block copolymers; waxes in which the main component is a fatty acid ester, such as carnauba wax; and waxes provided by the partial or complete deacidification of fatty acid esters, such as deacidified carnauba wax.

Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between a fatty acid, e.g., palmitic acid, stearic acid, behenic acid, or montanic acid, and an alcohol such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; aliphatic metal salts (generally known as metal soaps) such as calcium stearate, calcium laurate, zinc stearate, and magnesium stearate; waxes provided by grafting an aliphatic hydrocarbon wax using a vinyl monomer such as styrene or acrylic acid; partial esters between a polyhydric alcohol and a fatty acid, such as behenic monoglyceride; and hydroxyl-group-containing methyl ester compounds obtained by the hydrogenation of plant oils.

Among the preceding waxes, hydrocarbon waxes, e.g., paraffin waxes and Fischer-Tropsch waxes, are preferred from the perspective of improving the low-temperature fixability.

The wax is preferably used in the present invention at ranging from 0.5 mass part to 20 mass parts per 100 mass parts of the binder resin. The wax preferably has a peak temperature for the highest endothermic peak of ranging from 45° C. to 140° C.

The colorant used in the toner of the present invention can be exemplified as follows.

Black colorants can be exemplified by carbon black and colorants providing by color mixing using a yellow colorant, magenta colorant, and cyan colorant to yield black. Pigment may be used alone for the colorant, but the improved sharpness provided by the co-use of a dye with a pigment is more preferred from the standpoint of the image quality of the full-color image.

Colored pigments for magenta toners can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 192, 202, 206, 207, 209, 238, 269, and 282; C. I. Pigment Violet 19; and C. I. Vat Red 1, 2, 10, 13, 15, 23, 29, and 35.

Dyes for magenta toners can be exemplified by oil-soluble dyes such as C. I. Solvent Red 1, 3, 8, 23, 24, 25, 27, 30, 49, 81, 82, 83, 84, 100, 109, and 121, C. I. Disperse Red 9, C. I. Solvent Violet 8, 13, 14, 21, and 27, and C. I. Disperse Violet 1; and basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28.

Colored pigments for cyan toners can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Colored dyes for cyan can be exemplified by C. I. Solvent Blue 70.

Colored pigments for yellow can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Colored dyes for yellow can be exemplified by C. I. Solvent Yellow 162.

The amount of use of the colorant is preferably in a range from 0.1 mass part to 30 mass parts per 100 mass parts of the binder resin.

An external additive is preferably added to the toner of the present invention in order to improve the flowability and for durability stabilization. The external additive is preferably an inorganic fine powder such as silica, titanium oxide, or aluminum oxide. The inorganic fine powder is preferably subjected to a hydrophobic treatment with a hydrophobing agent such as a silane compound, silicone oil, or a mixture of the preceding.

The external additive for improving flowability is preferably an inorganic fine powder having a specific surface area ranging from 50 $m^2/g$ to 400 $m^2/g$, while the external additive for durability stabilization is preferably an inorganic fine powder with a specific surface area ranging from 10 $m^2/g$ to 50 $m^2/g$. A combination of inorganic fine powders with specific surface areas in the above-described ranges may be used in order to obtain both durability stabilization and improved flowability.

The external additive is preferably used at ranging from 0.1 mass part to 5.0 mass parts per 100 mass parts of the toner particles. A known mixer, such as a Henschel mixer, can be used to mix the toner particles and external additive.

The method of producing the toner of the present invention comprises a step of attaching the above-described metal compound on the surface of a toner particle comprising a binder resin and a wax and then carrying out a surface treatment with a hot air current, but is not otherwise particularly limited.

Accordingly, the method of producing the above-described toner particle is also not particularly limited and known methods can be used, for example, the following methods:

pulverization methods, in which the resin binder and wax are melt kneaded and the mixture is cooled and then pulverized and classified; suspension granulation methods, in which suspension granulation is performed by introducing a solution of the binder resin and wax dissolved or dispersed in a solvent into an aqueous medium and the toner particles are then obtained by removing the solvent; suspension polymerization methods, in which a monomer composition, prepared by uniformly dissolving or dispersing the wax and so forth in monomer, is dispersed in a continuous layer (for example, an aqueous phase) that contains a dispersion stabilizer and the toner particles are then produced by carrying out a polymerization reaction; dispersion polymerization methods, in which the toner particles are directly produced using an aqueous organic solvent in which the monomer is soluble but the obtained polymer is insoluble; emulsion polymerization methods, in which the toner particles are produced by polymerization directly in the presence of a water-soluble polar polymerization initiator; and emulsion aggregation methods, in which the toner particles are obtained proceeding through a step of forming an aggregate of finely divided particles by aggregating at least a wax and a finely divided polymer and an aging step of inducing melt adhesion among the finely divided particles in the aggregate of finely divided particles.

The production sequences for the toner particle and toner are described in the following for the example of the above-described pulverization method.

In a raw material mixing step, the materials that will constitute the toner particles, for example, the binder resin and wax and other optional components such as colorant and charge control agent, are metered out in prescribed amounts, blended, and mixed. The mixer can be exemplified by double-cone mixers, V-mixers, drum mixers, super mixers, Henschel mixers, Nauta mixers, and the Mechano Hybrid (Nippon Coke & Engineering Co., Ltd.).

The resulting raw material mixture is then melt kneaded in order to disperse the wax and so forth in the binder resin. A batch kneader such as a pressure kneader or a Banbury mixer or a continuous kneader can be used in this melt kneading step. A singe-screw or twin-screw extruder is typically used because they offer the advantage of enabling continuous production. Examples here are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.). The resin composition obtained by melt kneading may additionally be milled using a two-roll mill and cooled in a cooling step, for example, with water.

The cooled resin composition is then pulverized to the desired particle diameter in a pulverization step. In the pulverization step, a coarse pulverization is performed with a grinder such as a crusher, hammer mill, or feather mill, followed by a fine pulverization with a pulverizer such as a Krypton System (Kawasaki Heavy Industries, Ltd.), Super Rotor (Nisshin Engineering Inc.), or Turbo Mill (Turbo Kogyo Co., Ltd.) or using an air jet system.

The toner particles are then obtained as necessary by carrying out classification using a sieving apparatus or classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

In the present invention, the toner particles are also mixed with the above-described metal compound in a mixer, e.g., double-cone mixer, V-mixer, drum mixer, super mixer, Henschel mixer, Nauta mixer, Mechano Hybrid (Nippon Coke & Engineering Co., Ltd.), or Nobilta (Hosokawa Micron Corporation), in order to effect attachment, and this is followed by the execution of a surface treatment with a hot air current using a surface treatment device, e.g., the Meteo Rainbow MR Type (Nippon Pneumatic Mfg. Co., Ltd.).

A method for carrying out the above-described surface treatment using a hot air current is described schematically with reference to FIG. 1, but there is no limitation to this. FIG. 1 is a cross-sectional diagram that shows an example of a surface treatment apparatus that can be used for the present invention. Specifically, after the above-described pulverizate (also referred to here as toner particles) has been obtained, it is fed to this surface treatment apparatus. The toner particles (114) fed from a toner particle feeding port (100) are accelerated by injection air sprayed from a high-pressure air feeding nozzle (115) and are directed to an underlying air current spray member (102). Dispersion air is sprayed from the air current spray member (102) and the toner particles are dispersed outwardly by this dispersion air. The state of dispersion by the toner can be controlled at this point by adjusting the injection air flow rate and the dispersion air flow rate. To prevent melt adhesion of the toner particles, a cooling jacket (106) is disposed on the outer periphery of the toner particle feeding port (100), the outer periphery of the surface treatment apparatus, and the outer periphery of a transport conduit (116). Cooling water (preferably an antifreeze solution with, for example, ethylene glycol) preferably flows through this cooling jacket. The toner particles dispersed by the dispersion air are subjected to treatment of the surface of the toner particles by the hot air current fed from a hot air current feeding port (101). The ejection temperature of the hot air current should be larger than or equal to the softening point of the material (resin) constituting the toner particles, but is not otherwise particularly limited. Specifically, while this hot air current temperature will vary with the type of resin, as a general matter ranging from 100° C. to 300° C. is preferred and ranging from 150° C. to 250° C. is more preferred. It may not be possible to bring the toner particle surface into a molten state when the temperature of the hot air current is less than 100° C. In addition, excessive melting occurs when 300° C. is exceeded, in which case the wax may undergo segregation to the toner surface to an excessive degree and coarsening and melt adhesion of the toner particles—caused by the unification of toner particles with each other—may occur.

After the surfaces of the toner particles have been treated with the hot air current, the heat-treated toner particles are cooled by a cold air current feed from a cold air current feeding port (103) that is disposed on the upper periphery of the apparatus. At this time, For controlling the temperature distribution in the apparatus and for controlling the surface state of the heat-treated toner particles, a cold air current is preferably introduced from a second cold air current feeding port (104) that is disposed in a side surface of the main body of the apparatus. For example, a slit shape, louver configuration, porous plate configuration, or mesh configuration may be used for the outlet of this second cold air current feeding port (104), and, depending on the objective, a horizontal direction toward the center or a direction along the side wall of the apparatus can be selected for the direction of introduction.

The cold air current temperature at this time is preferably ranging from −50° C. to 10° C. and is more preferably ranging from −40° C. to 8° C. In addition, this cold air current is preferably a dehumidified cold air current. In specific terms, the cold air current has an absolute moisture content of preferably not more than 5 g/m$^3$. Not more than 3 g/m$^3$ is more preferred.

The temperature within the apparatus will end up declining too much when the temperature of this cold air current is less than −50° C., and the heat treatment that is the primary objective may then not proceed to an adequate degree and it may not be possible to bring the toner surface into a molten state. At above 10° C., the hot air current zone in the apparatus may not be satisfactorily controlled and the wax may undergo excessive segregation to the toner surface during the surface treatment.

The cooled toner particles are thereafter suctioned by a blower through the transport conduit (116) and are recovered, for example, by a cyclone.

The methods for measuring the properties of the toner and starting materials are described in the following.

<Measurement of the Acid Value of the Resins>

The acid value is the number of milligrams of potassium hydroxide required to neutralize the acid present in 1 g of a sample. The acid value of the binder resin is measured in accordance with JIS K 0070-1992. The measurement is specifically carried out by the following procedure.

(1) Reagent Preparation

A phenolphthalein solution is obtained by dissolving 1.0 g phenolphthalein in 90 mL ethyl alcohol (95 vol %) and bringing to 100 mL by the addition of ion-exchanged water.

7 g special-grade potassium hydroxide is dissolved in 5 mL water and brought to 1 L by the addition of ethyl alcohol (95 vol %). After standing for 3 days in an alkali-resistant container isolated from contact with, e.g., carbon dioxide, filtration is performed to obtain a potassium hydroxide solution. The obtained potassium hydroxide solution is stored in an alkali-resistant container. The factor for this potassium hydroxide solution is determined as follows: 25 mL of 0.1 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.1 mol/L hydrochloric acid is prepared based on JIS K 8001-1998.

(2) Procedure (A) The Main Test

A 2.0 g sample of the pulverized binder resin is precisely weighed into a 200-mL Erlenmeyer flask; 100 mL of a toluene:ethanol (4:1) mixed solution is added; and dissolution is carried out over 5 hours. Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) The Blank Test

Titration is performed using the same procedure as described above, except that the sample, i.e., only the toluene: ethanol (4:1) mixed solution is used.

(3) The acid value is calculated by substituting the obtained results into the following equation.

$$A=[(C-B)\times f\times 5.61]/S$$

wherein

A: acid value (mg KOH/g)

B: amount of addition of the potassium hydroxide solution in the blank test (mL)

C: amount of addition of the potassium hydroxide solution in the main test (mL)

f: factor for the potassium hydroxide solution

S: sample (g)

<Measurement of the Hydroxyl Value of the Resins>

The hydroxyl value is the number of milligrams of potassium hydroxide required to neutralize the acetic acid bonded with the hydroxyl group when 1 g of the sample is acetylated. The hydroxyl value of the binder resin is measured based on JIS K 0070-1992, and the measurement is specifically carried out using the following procedure.

(1) Reagent Preparation 25 g special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g phenolphthalein in 90 mL ethyl alcohol (95 vol %) and bringing to 100 mL by the addition of ion-exchanged water.

35 g special-grade potassium hydroxide is dissolved in 20 mL water and this is brought to 1 L by the addition of ethyl alcohol (95 vol %). After standing for 3 days in an alkali-resistant container isolated from contact with, e.g., carbon dioxide, filtration is performed to obtain the potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid is prepared based on JIS K 8001-1998.

(2) Procedure (A) The Main Test 1.0 g sample of the pulverized binder resin is precisely weighed into a 200-mL roundbottom flask and exactly 5.0 mL of the above-described acetylation reagent is added from a whole pipette. When the sample is difficult to dissolve in the acetylation reagent, dissolve by the addition of a small amount of special-grade toluene.

A small funnel is mounted in the mouth of the flask and heating is then carried out by immersing about 1 cm of the bottom of the flask in a glycerol bath at approximately 97° C. In order to prevent the temperature at the neck of the flask from rising at this point due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL water from the funnel and shaking. In order to accomplish complete hydrolysis, the flask is again heated for 10 minutes on the glycerol bath. After cooling, the funnel and flask walls are washed with 5 mL ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) The Blank Test

Titration is performed using the same procedure as described above, but without using the binder resin sample.

(3) The hydroxyl value is calculated by substituting the obtained results into the following equation.

$$A=[\{(B-C)\times 28.05\times f\}/S]+D$$

wherein

A: hydroxyl value (mg KOH/g)

B: amount of addition of the potassium hydroxide solution in the blank test (mL)

C: amount of addition of the potassium hydroxide solution in the main test (mL)

f: factor for the potassium hydroxide solution

S: sample (g)

D: acid value of the binder resin (mg KOH/g)

<Method of Measuring the Peak Molecular Weight (Mp), Number-Average Molecular Weight (Mn), and Weight-Average Molecular Weight (Mw) of the Resins>

The peak molecular weight (Mp), number-average molecular weight (Mn), and weight-average molecular weight (Mw) are measured by gel permeation chromatography (GPC) as follows.

First, the sample is dissolved in tetrahydrofuran (THF) over 24 hours at room temperature. The resin or toner is used as the sample. The obtained solution is filtered using a "Maeshori Disk" solvent-resistant membrane filter with a pore diameter of 0.2 μm (Tosoh Corporation) to obtain a sample solution. The sample solution is adjusted so as to provide a concentration of THF-soluble components of approximately 0.8 mass %. Measurement is performed under the following conditions using this sample solution.

instrument: HLC8120 GPC (detector: RI) (Tosoh Corporation)

columns: 7 column train of Shodex KF-801, 802, 803, 804, 805, 806, and 807 (Showa Denko KK)

eluent: tetrahydrofuran (THF)

flow rate: 1.0 mL/min oven temperature: 40.0° C.

sample injection amount: 0.10 mL

The sample molecular weight is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Measurement of the Glass-Transition Temperature (Tg) of the Resins>

The glass-transition temperature of the resins is measured based on ASTM D 3418-82 using a Q1000 (TA Instruments) differential scanning calorimeter.

The melting points of indium and zinc are used for temperature correction in the instrument's detection section, and the heat of fusion of indium is used to correct the amount of heat.

Specifically, approximately 5 mg of the resin is accurately weighed out and placed in an aluminum pan and the measurement is carried out at a rate of temperature rise of 10° C./min in the measurement range of 30 to 200° C. using an empty aluminum pan for reference. The change in the specific heat is obtained in the 40 to 100° C. temperature range in this temperature ramp-up step. In this case, the glass-transition temperature Tg of the resin is taken to be the intersection of the differential heat curve with the line for the midpoint for the baseline prior to the appearance of a change in the specific heat and the baseline after the change in the specific heat has appeared.

<Measurement of the Peak Temperature of the Highest Endothermic Peak of Waxes>

The peak temperature of the highest endothermic peak of the wax is measured based on ASTM D 3418-82 using a Q1000 (TA Instruments) differential scanning calorimeter. The melting points of indium and zinc are used for temperature correction in the instrument's detection section, and the heat of fusion of indium is used to correct the amount of heat.

Specifically, approximately 10 mg of the wax is accurately weighed out and placed in an aluminum pan and the measurement is carried out at a rate of temperature rise of 10° C./min in the measurement temperature range of 30 to 200° C. using an empty aluminum pan for reference. The measurement is performed by raising the temperature to 200° C., then lowering the temperature to 30° C., and thereafter raising the temperature once again. The peak temperature of the highest endothermic peak in the DSC curve in the 30 to 200° C. temperature range in this second temperature ramp-up step is taken to be the peak temperature of the highest endothermic peak in the endothermic curve in the DSC measurement of the wax used by the present invention.

<Method of Measuring the Weight-Average Particle Diameter (D4) of the Toner>

The weight-average particle diameter (D4) of the toner is calculated using a "Coulter Counter Multisizer 3" (registered trademark of Beckman Coulter, Inc.), which is a precision particle diameter distribution analyzer that uses the aperture electrical resistance principle and is equipped with a 100 μm aperture tube, and using the "Beckman Coulter Multisizer 3

Version 3.51" software (from Beckman Coulter, Inc.) provided with the instrument, to perform measurements at 25,000 channels for the number of effective measurement channels and to carry out analysis of the measurement data. A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software is set as follows prior to running the measurement and analysis.

On the "Change Standard Operating Method (SOM)" screen of the dedicated software, the total count number for the control mode is set to 50000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is introduced into the 250-mL round-bottom glass beaker provided for use with the Multisizer 3 and this is then set into the sample stand and counterclockwise stirring is performed with a stirring rod at 24 rotations per second. Dirt and bubbles in the aperture tube are removed using the "aperture flush" function of the analytic software.

(2) Approximately 30 mL of the above-described aqueous electrolyte solution is introduced into a 100-mL flatbottom glass beaker. To this is added the following as a dispersing agent: approximately 0.3 mL of a dilution prepared by diluting "Contaminon N" 3-fold on a mass basis with ion-exchanged water; "Contaminon N" is a 10 mass % aqueous solution of a neutral pH 7 detergent for cleaning precision measurement instrumentation and comprises a nonionic surfactant, an anionic surfactant, and an organic builder, from Wako Pure Chemical Industries, Ltd.

(3) A prescribed amount of ion-exchanged water is introduced into the water tank of an "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be ranging from 10° C. to 40° C.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4).

<Method of Measuring the Average Circularity of the Toner>

The average circularity of the toner is measured using an "FPIA-3000" flow-type particle image analyzer (Sysmex Corporation); the measurements are performed using the measurement and analysis conditions used during the calibration process.

The specific measurement method is as follows. Approximately 20 mL ion-exchanged water—from which, e.g., solid impurities and so forth, have already been removed—is first introduced into a glass container. To this is added as dispersing agent approximately 0.2 mL of a dilution prepared by the approximately 3-fold (mass) dilution with ion-exchanged water of "Contaminon N" (a 10 mass % aqueous solution (pH 7) of a neutral detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for measurement. Cooling is carried out as appropriate during this treatment so as to provide a dispersion temperature in a range of 10° C. to 40° C. A benchtop ultrasound cleaner/disperser having an oscillation frequency of 50 kHz and an electrical output of 150 W (for example, a VS-150 from Velvo-Clear Co., Ltd.) is used as the ultrasound disperser. A prescribed amount of ion-exchanged water is introduced into the water tank and approximately 2 mL Contaminon N is added to the water tank.

The above-described flow-type particle image analyzer fitted with a standard objective lens (10×) is used for the measurement, and Particle Sheath "PSE-900A" (Sysmex Corporation) is used for the sheath solution. The dispersion prepared according to the above-described procedure is introduced into the flow-type particle image analyzer and 3,000 toner particles are measured according to the total count mode in HPF measurement mode. By setting the binarization threshold value during particle analysis to 85% and specifying the analyzed particle diameter, the average circularity of particles in this range can be calculated. For the average circularity of the toner, the average circularity of the toner is determined for a circle-equivalent diameter set to ranging from 1.98 μm to 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

The examples in this application used a flow-type particle image analyzer that had been calibrated by the Sysmex Corporation and that had been issued a calibration certificate by the Sysmex Corporation. Except for limiting the analyzed particle diameter in a range from 1.98 μm to 39.69 μm, the measurements were carried out using the same measurement and analysis conditions as when the calibration certification was received.

<Measurement of the BET Specific Surface Area of the External Additive>

The BET specific surface area of the external additive is measured based in JIS Z 8830 (2001). The specific measurement method is as follows.

A "TriStar 3000 Automatic Specific Surface Area. Porosimetry Analyzer" (Shimadzu), which uses gas adsorption by a constant volume procedure as its measurement methodology, is used as the measurement instrument. The measurement conditions are set and the measurement data is analyzed using "TriStar 3000 Version 4.00", the dedicated software provided with this instrument. In addition, a vacuum pump, nitrogen gas conduit, and helium gas conduit are connected to the instrument. The value calculated using a multipoint BET method and using nitrogen gas as the adsorption gas is taken to be the BET specific surface area.

The BET specific surface area is calculated as follows.

First, nitrogen gas is adsorbed to the external additive and the equilibration pressure P (Pa) within the sample cell and the amount of nitrogen adsorption Va ($mol \cdot g^{-1}$) by the external additive are measured at this point. The adsorption isotherm is obtained using the relative pressure Pr—which is the value provided by dividing the equilibration pressure P (Pa) within the sample cell by the saturation vapor pressure of nitrogen Po (Pa)—for the horizontal axis and the amount of nitrogen adsorption Va ($mol \cdot g^{-1}$) for the vertical axis. The monomolecular layer adsorption amount Vm ($mol \cdot g^{-1}$), which is the amount of adsorption required to form a monomolecular layer on the surface of the external additive, is then determined using the BET equation provided below $$Pr/Va(1-Pr)=1/(Vm\times C)+(C-1)\times Pr/(Vm\times C)$$

wherein C is the BET parameter and is a variable that changes with the type of measurement sample, the type of adsorption gas, and the adsorption temperature.

The BET equation can be rendered as a straight line, with a slope of (C−1)/(Vm×C) and an intercept of 1/(Vm×C), by using Pr for the X-axis and Pr/Va(1−Pr) for the Y-axis (this straight line is called a BET plot).

slope of the straight line=(C−1)/(Vm×C)

intercept of the straight line=1/(Vm×C)

The value of the slope and the value of the intercept can be calculated for the straight line obtained by plotting the measured values of Pr and the measured values of Pr/Va(1−Pr) on a graph and generating a straight line by the least-squares method. Using these values, Vm and C can be calculated by solving the above-described simultaneous equations for the slope and intercept.

The BET specific surface area S ($m^2/g$) of the external additive is then calculated using the following equation and the value of Vm calculated as above and the molecular cross-sectional area of the nitrogen molecule (0.162 $nm^2$)

$$S=Vm\times N\times 0.162\times 10^{-18}$$

wherein N is Avogadro's number ($mol^{-1}$).

Measurements using this instrument are run according to the "TriStar 3000 Operating Manual V4.0" provided with the instrument and specifically are run using the following procedure.

The glass sample cell (stem diameter=⅜ inch, volume=approximately 5 mL) provided with the instrument is thoroughly cleaned and dried and then precisely weighed to determine the tare value. Approximately 0.1 g of the external additive is introduced into this sample cell using a funnel.

The external additive-loaded sample cell is set in a "Vacuprep 061 Pretreatment Apparatus" (Shimadzu) connected to the vacuum pump and nitrogen gas line and vacuum degassing is carried out for approximately 10 hours at 23° C. This vacuum degassing is performed by gradually degassing while adjusting the valve in order to avoid suctioning the external additive into the vacuum pump. The pressure in the cell gradually drops as degassing proceeds and approximately 0.4 Pa (approximately 3 millitorr) is finally reached. After the completion of vacuum degassing, nitrogen gas is gradually introduced and the interior of the sample cell is returned to atmospheric pressure and the sample cell is removed from the pretreatment apparatus. The mass of this sample cell is accurately weighed and the precise mass of the external additive is calculated from the difference from the tare value. The sample cell is closed with a rubber stopper during weighing in order to prevent the external additive in the sample cell from being contaminated with, for example, moisture in the atmosphere.

The "isothermal jacket" provided with the instrument is installed on the stem of this external additive-loaded sample cell. The filler rod provided with the instrument is inserted into the sample cell and the sample cell is set in the analysis port of the instrument. This isothermal jacket is a cylindrical element whose inside is composed of a porous material and whose outside is composed of an impermeable material, and it can draw up the liquid nitrogen by capillary phenomena to a prescribed level.

Measurement of the free space in the sample cell including the connection fixtures is then performed. For the free space, the volume of the sample cell is measured at 23° C. using helium gas; then, after the sample cell has been cooled with liquid nitrogen, the volume of the sample cell is similarly measured using helium gas; and the free space is calculated converting from the difference in these volumes. In addition, the saturation vapor pressure Po (Pa) of nitrogen is automatically measured separately using the Po tube built into the instrument.

Then, after the interior of the sample cell has been vacuum degassed, the sample cell is cooled with liquid nitrogen while vacuum degassing is continued. After this, nitrogen gas is admitted in stages into the sample cell and the nitrogen molecules are adsorbed to the toner. At this point, the above-described adsorption isotherm is obtained by measurement of the equilibration pressure P (Pa) as required, and this adsorption isotherm is converted to a BET plot. The relative pressure Pr points for data collection are set at a total of six points, i.e., 0.05, 0.10, 0.15, 0.20. 0.25, and 0.30. A straight line is generated by the least-squares method from the obtained measurement data and Vm is calculated from the slope and intercept of this straight line. Using this value for Vm, the BET specific surface area of the external additive is calculated as described above.

EXAMPLES

Specific examples of the present invention are described below, but the present invention is not limited by these examples. The "parts" and "%" used below in relation to mixing are on a mass basis in the absence of a specific designation.

<Production Example for Polyester Resin A>

72.5 mass parts of polyoxypropylene(2.2)-2,2-bis(4-hydroxyphenyl) propane, 24.5 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C.

while stirring and a reaction was run for 6 hours. 3.0 mass parts of trimellitic anhydride was subsequently added and a reaction was run for 2 hours at 180° C. to obtain polyester resin A.

Polyester resin A had an acid value of 15 mg KOH/g and a hydroxyl value of 45 mg KOH/g. Its molecular weight by GPC was as follows: weight-average molecular weight (Mw)=11,000; number-average molecular weight (Mn)=4,000; and peak molecular weight (Mp)=7,600. It had a softening point of 105° C.

<Production Example for Polyester Resin B>

70.0 mass parts of polyoxypropylene(2.2)-2,2-bis(4-hydroxyphenyl) propane, 23.9 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 6 hours. 3.0 mass parts of trimellitic anhydride and 3.1 mass parts of benzoic acid were subsequently added and a reaction was run for 2 hours at 180° C. to obtain polyester resin B.

Polyester resin B had an acid value of 16 mg KOH/g and a hydroxyl value of 16 mg KOH/g. Its molecular weight by GPC was as follows: weight-average molecular weight (Mw)=11,000; number-average molecular weight (Mn)=4,000; and peak molecular weight (Mp)=7,600. It had a softening point of 105° C.

<Production Example for Polyester Resin C>

70.0 mass parts of polyoxypropylene(2.2)-2,2-bis(4-hydroxyphenyl)propane, 23.8 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 6 hours. 2.8 mass parts of trimellitic anhydride and 3.4 mass parts of benzoic acid were subsequently added and a reaction was run for 2 hours at 180° C. to obtain polyester resin C.

Polyester resin C had an acid value of 15 mg KOH/g and a hydroxyl value of 8 mg KOH/g. Its molecular weight by GPC was as follows: weight-average molecular weight (Mw)=11,000; number-average molecular weight (Mn)=4,000; and peak molecular weight (Mp)=7,600. It had a softening point of 105° C.

<Production Example for Polyester Resin D>

74.6 mass parts of polyoxypropylene(2.2)-2,2-bis(4-hydroxyphenyl) propane, 25.4 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 6 hours to obtain polyester resin D.

Polyester resin D had an acid value of 1 mg KOH/g and a hydroxyl value of 70 mg KOH/g. Its molecular weight by GPC was as follows: weight-average molecular weight (Mw)=11,000; number-average molecular weight (Mn)=4,000; and peak molecular weight (Mp)=7,500. It had a softening point of 105° C.

<Production Example for Polyester Resin E>

50.0 mass parts of polyoxypropylene(2.2)-2,2-bis(4-hydroxyphenyl) propane, 25.0 mass parts of polyoxyethylene (2.2)-2,2-bis(4-hydroxyphenyl)propane, 25.0 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 5 hours to obtain polyester resin E.

Polyester resin E had an acid value of 1 mg KOH/g and a hydroxyl value of 85 mg KOH/g. Its molecular weight by GPC was as follows: weight-average molecular weight (Mw)=7,600; number-average molecular weight (Mn)=3,500; and peak molecular weight (Mp)=6,000. It had a softening point of 100° C.

<Production Example for Polyester Resin F>

72.4 mass parts of polyoxypropylene(2.2)-2,2-bis(4-hydroxyphenyl) propane, 25.6 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 6 hours. 2.0 mass parts of benzoic acid was subsequently added and a reaction was run for 2 hours at 180° C. to obtain polyester resin F.

Polyester resin F had an acid value of 1 mg KOH/g and a hydroxyl value of 45 mg KOH/g. Its molecular weight by GPC was as follows: weight-average molecular weight (Mw)=11,000; number-average molecular weight (Mn)=4,000; and peak molecular weight (Mp)=7,700. It had a softening point of 105° C.

<Production Example for Polyester Resin G>

72.4 mass parts of polyoxypropylene(2.2)-2,2-bis(4-hydroxyphenyl) propane, 25.6 mass parts of terephthalic acid, and 0.5 mass part of titanium tetrabutoxide were introduced into a 4-L four-neck glass flask. This four-neck flask was fitted with a thermometer, stirring rod, condenser, and nitrogen inlet tube and was placed in a mantle heater. The interior of the four-neck flask was then substituted with nitrogen gas, after which the temperature was gradually raised to 220° C. while stirring and a reaction was run for 6 hours. 2.0 mass parts of trimellitic anhydride was subsequently added and a reaction was run for 2 hours at 180° C. to obtain polyester resin G.

Polyester resin G had an acid value of 45 mg KOH/g and a hydroxyl value of 15 mg KOH/g. Its molecular weight by GPC was as follows: weight-average molecular weight (Mw)=11,000; number-average molecular weight (Mn)=4,000; and peak molecular weight (Mp)=7,700. It had a softening point of 105° C.

The properties of the polyester resins obtained in the production examples for polyester resins A to G are shown in Table 1.

TABLE 1

| polyester resin | acid value mg KOH/g | hydroxyl value mg KOH/g | number-average molecular weight Mn | weight-average molecular weight Mw | peak molecular weight Mp | glass transition temperature Tg (° C.) | softening point Tm (° C.) |
|---|---|---|---|---|---|---|---|
| A | 15 | 45 | 4,000 | 11,000 | 7,600 | 54 | 105 |
| B | 16 | 16 | 4,000 | 11,000 | 7,600 | 54 | 105 |
| C | 15 | 8 | 4,000 | 11,000 | 7,600 | 54 | 105 |
| D | 1 | 70 | 4,000 | 11,000 | 7,500 | 54 | 105 |
| E | 1 | 85 | 3,500 | 7,600 | 6,000 | 52 | 100 |
| F | 1 | 45 | 4,000 | 11,000 | 7,700 | 54 | 105 |
| G | 45 | 15 | 4,000 | 11,000 | 7,700 | 54 | 105 |

<Toner Production Example 1>

[The Toner Particle Production Step]

| | |
|---|---|
| polyester resin A: | 100 mass parts |
| Fischer-Tropsch wax (peak temperature of the highest endothermic peak = 78° C.): | 5 mass parts |
| C. I. Pigment Blue 15: 3: | 5 mass parts |

This formulation was mixed with a Henschel mixer (model FM-75, from Mitsui Miike Chemical Engineering Machinery Co., Ltd.) and then kneaded using a twin-screw kneader (model PCM-30, from the Ikegai Corp.) set at a temperature of 120° C. The obtained mixture was cooled and coarsely pulverized to 1 mm and below with a hammer mill to obtain a coarse pulverizate. The obtained coarse pulverizate was pulverized using a mechanical grinder (T-250, from Turbo Kogyo Co., Ltd.) to obtain a fine pulverizate. The obtained fine pulverizate was classified with a Coanda effect-based multifraction classifier, thereby yielding toner particles 1.

[The Surface Treatment Step]

| | |
|---|---|
| the obtained toner particles 1: | 100 mass parts |
| aluminum compound of 3,5-di-tertiary-butylsalicylic acid (Bontron E88, from Orient Chemical Industries Co., Ltd): | 0.3 mass part |

The structural formula of 3,5-di-tertiary-butylsalicylic acid is given by formula (5) below.

[Chem 6]

(5)

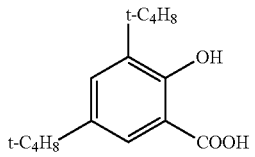

Metal compound-bearing toner particles 1, in which the metal compound was attached to the surface of toner particles 1, were obtained by mixing the above-described formulation with a Henschel mixer (model FM-75, from Mitsui Miike Chemical Engineering Machinery Co., Ltd.).

Surface-treated toner particles 1 were obtained by subjecting the obtained metal compound-bearing toner particles 1 to a surface treatment using the surface treatment apparatus shown in FIG. 1.

With regard to the conditions during the surface modification, surface modification was carried out at a starting material feeding rate of 2.0 kg/hr, a hot air current flow rate of 4.5 $m^3$/min, a hot air current ejection temperature of 210° C., a cold air temperature of 3° C., a cold air current flow rate of 3.0 $m^3$/min, and an absolute moisture content of 3 g/$m^3$.

The obtained surface-treated toner particles 1 were again subjected to classification using a Coanda effect-based multifraction classifier to provide classified surface-treated toner particles 1 having the desired particle diameter.

[The External Addition Step]

1.0 mass part titanium oxide fine powder that had been surface-treated with 16 mass % isobutyltrimethoxysilane and 0.8 mass part hydrophobic silica fine powder that had been surface-treated with 10 mass % hexamethyldisilazane were added to 100 mass parts of the resulting classified surface-treated toner particles 1, and toner 1 was then obtained by mixing with a Henschel mixer (model FM-75, from Mitsui Miike Chemical Engineering Machinery Co., Ltd.). The properties of the obtained toner 1 are shown in Table 2.

<Toner Production Examples 2 to 12 and 21 to 24>

Toners 2 to 12 and 21 to 24 were obtained proceeding as in Toner Production Example 1, with the exception that a part of Toner Production Example 1 was changed as shown in Table 2. The properties of the obtained toners 2 to 12 and 21 to 24 are shown in Table 2.

<Toner Production Example 13>

Toner 13 was obtained proceeding as in Toner Production Example 12, with the exception that the aluminum compound of 3,5-di-tertiary-butylsalicylic acid used in Toner Production Example 12 was changed to a zinc compound of 3,5-di-tertiary-butylsalicylic acid. The properties of the obtained toner 13 are shown in Table 2.

<Toner Production Example 14>

Toner 14 was obtained proceeding as in Toner Production Example 12, with the exception that the aluminum compound of 3,5-di-tertiary-butylsalicylic acid used in Toner Production Example 12 was changed to a zirconium compound of 3,5-di-tertiary-butylsalicylic acid. The properties of the obtained toner 14 are shown in Table 2.

<Toner Production Example 15>

Toner 15 was obtained proceeding as in Toner Production Example 12, with the exception that the aluminum compound of 3,5-di-tertiary-butylsalicylic acid used in Toner Production Example 12 was changed to a chromium compound of 3,5-di-tertiary-butylsalicylic acid. The properties of the obtained toner 15 are shown in Table 2.

<Toner Production Example 16>

Toner 16 was obtained proceeding as in Toner Production Example 12, with the exception that the aluminum compound of 3,5-di-tertiary-butylsalicylic acid used in Toner Production Example 12 was changed to an aluminum compound of 3,5-dimethylsalicylic acid. The properties of the obtained toner 16 are shown in Table 2. The structural formula of 3,5-dimethylsalicylic acid is given by formula (6) below.

[Chem 7]

(6)

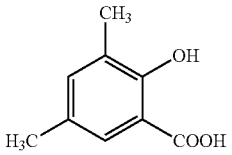

<Toner Production Example 17>

Toner 17 was obtained proceeding as in Toner Production Example 12, with the exception that the aluminum compound of 3,5-di-tertiary-butylsalicylic acid used in Toner Production Example 12 was changed to an aluminum compound of 3-ethylsalicylic acid. The properties of the obtained toner 17 are shown in Table 2. The structural formula of 3-ethylsalicylic acid is given by formula (7) below.

[Chem 8]

(7)

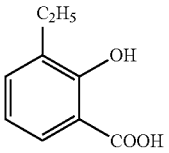

<Toner Production Example 18>

Toner 18 was obtained proceeding as in Toner Production Example 12, with the exception that the aluminum compound of 3,5-di-tertiary-butylsalicylic acid used in Toner Production Example 12 was changed to an aluminum compound of 3-methyl-5-propylsalicylic acid. The properties of the obtained toner 18 are shown in Table 2. The structural formula of 3-methyl-5-propylsalicylic acid is given by formula (8) below.

[Chem 9]

(8)

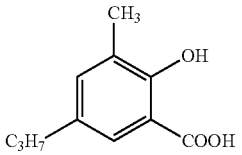

<Toner Production Example 19>

Toner 19 was obtained proceeding as in Toner Production Example 12, with the exception that the aluminum compound of 3,5-di-tertiary-butylsalicylic acid used in Toner Production Example 12 was changed to an aluminum compound of 3,5-dihexylsalicylic acid. The properties of the obtained toner 19 are shown in Table 2. The structural formula of 3,5-dihexylsalicylic acid is given by formula (9) below.

[Chem 10]

(9)

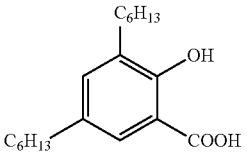

<Toner Production Example 20>

Toner 20 was obtained proceeding as in Toner Production Example 12, with the exception that the aluminum compound of 3,5-di-tertiary-butylsalicylic acid used in Toner Production Example 12 was changed to an aluminum compound of 2-hydroxy-1-naphthalenecarboxylic acid. The properties of the obtained toner 20 are shown in Table 2. The structural formula of 2-hydroxy-1-naphthalenecarboxylic acid is given by formula (10) below.

[Chem 11]

(10)

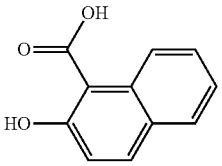

TABLE 2

| | binder | surface treatment step | | | | toner properties | |
|---|---|---|---|---|---|---|---|
| toner production example | resin in the toner particle production step | structure of the aromatic hydroxy-carboxylic acid | central metal | number of parts | heat treatment | average circularity | weight-average particle diameter (D4) mm |
| 1 | polyester resin A | formula (5) | Al | 0.3 | yes | 0.969 | 6.2 |
| 2 | polyester resin A | formula (5) | Al | 1.0 | yes | 0.969 | 6.1 |
| 3 | polyester resin A | formula (5) | Al | 2.0 | yes | 0.968 | 6.1 |
| 4 | polyester resin A | formula (5) | Al | 4.0 | yes | 0.967 | 6.1 |

TABLE 2-continued

| | binder | surface treatment step | | | | toner properties | |
|---|---|---|---|---|---|---|---|
| toner production example | resin in the toner particle production step | structure of the aromatic hydroxy-carboxylic acid | central metal | number of parts | heat treatment | average circularity | weight-average particle diameter (D4) mm |
| 5 | polyester resin A | formula (5) | Al | 4.5 | yes | 0.967 | 6.1 |
| 6 | polyester resin A | formula (5) | Al | 0.1 | yes | 0.970 | 6.2 |
| 7 | polyester resin B | formula (5) | Al | 0.3 | yes | 0.969 | 6.1 |
| 8 | polyester resin C | formula (5) | Al | 0.3 | yes | 0.968 | 6.1 |
| 9 | polyester resin D | formula (5) | Al | 0.3 | yes | 0.967 | 6.2 |
| 10 | polyester resin E | formula (5) | Al | 0.3 | yes | 0.971 | 6.1 |
| 11 | polyester resin F | formula (5) | Al | 0.3 | yes | 0.969 | 6.2 |
| 12 | polyester resin G | formula (5) | Al | 0.3 | yes | 0.967 | 6.1 |
| 13 | polyester resin G | formula (5) | Zn | 0.3 | yes | 0.969 | 6.1 |
| 14 | polyester resin G | formula (5) | Zr | 0.3 | yes | 0.968 | 6.2 |
| 15 | polyester resin G | formula (5) | Cr | 0.3 | yes | 0.967 | 6.1 |
| 16 | polyester resin G | formula (6) | Al | 0.3 | yes | 0.971 | 6.2 |
| 17 | polyester resin G | formula (7) | Al | 0.3 | yes | 0.969 | 6.1 |
| 18 | polyester resin G | formula (8) | Al | 0.3 | yes | 0.967 | 6.1 |
| 19 | polyester resin G | formula (9) | Al | 0.3 | yes | 0.967 | 6.1 |
| 20 | polyester resin G | formula (10) | Al | 0.3 | yes | 0.967 | 6.1 |
| 21 | polyester resin G | zinc stearate | — | 0.3 | yes | 0.970 | 6.2 |
| 22 | polyester resin G | finely divided resin particles | — | 4.0 | yes | 0.968 | 6.1 |
| 23 | polyester resin G | — | — | 0.0 | yes | 0.970 | 6.3 |
| 24 | polyester resin G | formula (5) | Al | 0.3 (after heat treatment) | yes | 0.970 | 6.3 |

Example 1

The heat-resistant storability was evaluated using the toner 1 obtained in Toner Production Example 1.

<Evaluation of the Heat-Resistant Storability>

The method of evaluating the heat-resistant storability comprised introducing 5 g of the evaluation sample into a container (polyethylene cup with a capacity of 50 mL) and holding for 1 week at 50° C. After the 1-week holding period, the evaluation sample was transferred into a 23° C./60% RH environment and was held there overnight.

The degree of agglomeration was measured on the evaluation sample provided by this procedure.

The measurement of the degree of agglomeration used a "MODEL 1332A Digivibro" digital-display vibrometer (Showa Sokki Corporation) connected to the side of the vibrating table of a "Powder Tester" (Hosokawa Micron Corporation). The following were installed stacked in sequence from bottom to top in the vibrating table of the Powder Tester: a sieve with an aperture of 38 μm (400 mesh), a sieve with an aperture of 75 μm (200 mesh), and a sieve with an aperture of 150 μm (100 mesh). The measurement was performed as described below in a 23° C./60% RH environment.

(1) The oscillation amplitude of the vibrating table was preliminarily adjusted to give 0.40 mm (peak-to-peak) for the displacement value on the digital-display vibrometer.

(2) The above-described evaluation sample was gently placed on the 150 μm-aperture sieve of the uppermost stage.

(3) The sieves were vibrated for 15 seconds, after which the mass of the toner remaining on each sieve was measured and the degree of agglomeration was calculated based on the following formula.

$$\text{degree of agglomeration (\%)} = \{(\text{sample mass (g) on the 150 μm-aperture sieve})/5\ \text{(g)}\} \times 100 + \{(\text{sample mass (g) on the 75 μm-aperture sieve})/5\ \text{(g)}\} \times 100 \times 0.6 + \{(\text{sample mass (g) on the 38 μm-aperture sieve})/5\ \text{(g)}\} \times 100 \times 0.2$$

In addition, the same toner as used for the evaluation sample was held at least overnight in a 23° C./60% RH environment to provide a sample and this sample was submitted to the same measurement of the degree of agglomeration as described above. The change in the degree of agglomeration was determined from ([degree of agglomeration of the sample in a 23° C./60% RH environment]/[degree of agglomeration of the evaluation sample after 1 week at 50° C.]×100), and the heat-resistant storability was then evaluated using the following evaluation scale.

A: 90% or more, =very good

B: 80% or more but less than 90%, =a generally unproblematic level

C: 75% or more but less than 80%, =weak heat-resistant storability, but an unproblematic level for actual use D: less than 75%, =problematic heat-resistant storability The results of the evaluation are shown in Table 3. As shown in Table 3, the heat-resistant storability was improved by the execution of the surface treatment with the hot air current after attachment of the metal compound. In addition, a trend was present wherein the heat-resistant storability increased as the amount of addition of the metal compound increased.

A two-component developer was obtained by mixing the toner 1 obtained in Toner Production Example 1 with magnetic ferrite carrier particles (surface coated with silicone resin, number-average particle diameter=35 μm) to provide a toner concentration of 6 mass %. The obtained two-component developer was used to carry out an evaluation of the fixing performance and to carry out durability testing.

<Evaluation of the Fixing Performance (Low-Temperature Fixation Temperature)>

Testing of the fixation temperature region was performed using an imagePress C1+ full-color copier (Canon) that had been modified to enable free selection of the fixation temperature. For the image, an unfixed image was produced in single-color mode in a normal temperature/normal humidity environment (23° C./50 to 60%) with the toner laid-on level on the paper adjusted to 1.2 mg/cm$^2$. The paper used in the evaluation was CS-814 copy paper (A4, areal weight=81.4 g/m$^2$, commercial product from Canon Marketing Japan Inc.), and an image was formed at an image coverage rate of 25%. Fixing was then performed in a normal temperature/normal humidity environment (23° C./50 to 60%) with the fixation temperature being raised in 5° C. increments in sequence from 100° C., and the low-temperature fixation temperature was taken to be the temperature at which offset and wrap around were no longer produced. The results of the evaluation are shown in Table 3.

As shown in Table 3, the low-temperature fixability presents a modest tendency to deteriorate with an increasing amount of metal compound addition. However, as compared to the system in which finely divided resin particles were added, there is little influence on the low-temperature fixability although the same level of heat-resistant storability is exhibited, and it can thus be concluded that metal crosslinking between the metal compound and polyester resin is occurring only at the surface.

<Durability (Multiprint Output) Testing (Initial Quantity of Toner Charge and Durability Testing Results)>

The developing device and supply container were installed in a modified imagePress C1+ full-color copier (Canon) in a 20° C./8% RH environment; the developing bias was then set to give a toner laid-on level on the photosensitive member of 0.6 g/cm$^2$; a solid image was output; and the density of this solid image was measured.

In addition, a solid image was output at a developing bias set as described above; development was stopped at the point at which the toner image had been formed on the photosensitive member; and the toner on the photosensitive member was suctioned off and collected using a cylindrical metal tube and a cylindrical filter. The quantity of charge Q passing through this cylindrical metal tube and accumulated in a capacitor during this process and the mass M of the collected toner were measured, and the quantity of charge per unit mass Q/M (mC/kg) was calculated and taken to be the Q/M (mC/kg) on the photosensitive member.

Then, using an image with a coverage rate of 1%, 20,000 (20 k) prints of the image were output while implementing a prescribed supply amount so as to provide a constant toner density. After the completion of the 20 k output, a solid image was output and the density of the solid image was measured.

With regard to the image density, the image density was measured using an X-Rite 500 densitometer, and the average value for 5 points was taken to be the image density. The image density change D1-D20 was calculated where D1 is the initial image density and D20 is the image density after the 20 k durability test.

[The D1-D20 Evaluation Results]

A: the image density change D1-D20 is less than 0.05

B: the image density change D1-D20 is at least 0.05 but less than 0.10

C: the image density change D1-D20 is at least 0.10 but less than 0.20 (acceptable level for the present invention)

D: the image density change D1-D20 is at least 0.20 (not acceptable for the present invention)

The evaluation results are shown in Table 3. As shown in Table 3, for the systems in which a metal compound has been added to the surface, a trend of an improving initial quantity of toner charge was present regardless of the presence/absence of surface treatment with a hot air current. This is thought to be due to the metal compounds used in these examples having the properties of a charge control agent.

Examples 2 to 20 and Comparative Examples 1 to 4

The heat-resistant storability was evaluated as in Example 1 using the toners 2 to 24 obtained in Toner Production Examples 2 to 24.

In addition, two-component developers were obtained as in Example 1 using magnetic ferrite carrier particles (surface coated with silicone resin, number-average particle diameter=35 μm) and the toners 2 to 24 obtained in Toner Production Examples 2 to 24, and fixing performance evaluation and durability testing were carried out as in Example 1. The evaluation results are given in Table 3.

TABLE 3

| example/ comparative example | toner production example | low-temperature fixation temperature (° C.) | heat resistant durability (50° C., 1 week) | initial quantity of toner charge (mC/kg) | durability testing results |
|---|---|---|---|---|---|
| Example 1 | 1 | 130 | B(81%) | −31 | A(0.03) |
| Example 2 | 2 | 130 | B(85%) | −33 | A(0.03) |
| Example 3 | 3 | 135 | B(88%) | −35 | B(0.06) |
| Example 4 | 4 | 135 | A(92%) | −36 | C(0.10) |
| Example 5 | 5 | 140 | A(95%) | −37 | C(0.11) |
| Example 6 | 6 | 130 | C(77%) | −28 | A(0.03) |
| Example 7 | 7 | 130 | C(77%) | −28 | A(0.04) |
| Example 8 | 8 | 130 | C(75%) | −27 | A(0.04) |
| Example 9 | 9 | 135 | A(92%) | −24 | A(0.03) |
| Example 10 | 10 | 140 | A(95%) | −25 | A(0.02) |
| Example 11 | 11 | 130 | B(81%) | −24 | A(0.02) |
| Example 12 | 12 | 130 | C(78%) | −35 | B(0.09) |
| Example 13 | 13 | 130 | C(75%) | −33 | B(0.06) |
| Example 14 | 14 | 130 | B(81%) | −35 | B(0.09) |

TABLE 3-continued

| example/ comparative example | toner production example | low-temperature fixation temperature (° C.) | heat resistant durability (50° C., 1 week) | initial quantity of toner charge (mC/kg) | durability testing results |
|---|---|---|---|---|---|
| Example 15 | 15 | 130 | C(75%) | −27 | C(0.11) |
| Example 16 | 16 | 135 | C(76%) | −28 | B(0.09) |
| Example 17 | 17 | 140 | C(77%) | −30 | B(0.07) |
| Example 18 | 18 | 130 | C(78%) | −29 | B(0.06) |
| Example 19 | 19 | 130 | C(78%) | −31 | B(0.06) |
| Example 20 | 20 | 130 | C(78%) | −29 | B(0.06) |
| Comparative Example 1 | 21 | 130 | D(68%) | −37 | C(0.11) |
| Comparative Example 2 | 22 | 150 | A(90%) | −26 | C(0.10) |
| Comparative Example 3 | 23 | 130 | D(68%) | −25 | B(0.06) |
| Comparative Example 4 | 24 | 130 | D(70%) | −36 | B(0.09) |

REFERENCE SIGNS LIST

100: toner particle feeding port
101: hot air current feeding port
102: air current spray member
103: cold air current feeding port
104: second cold air current feeding port
106: cooling jacket
114: toner particle
115: high-pressure air feeding nozzle
116: transport conduit

The invention claimed is:

1. A toner having toner particles, each of which contains a binder resin and a wax, wherein, the toner is obtained by attaching a metal compound to the toner particles' surface and thereafter performing a surface treatment with a hot air current, the binder resin contains a polyester resin, the metal compound is formed by coordinating or bonding an aromatic oxycarboxylic acid represented by general formula (1) to a metal:

(1)

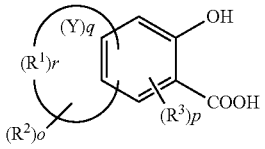

where, $R^1$ represents a quaternary carbon, methine, or methylene, each of which may contain N, S, O, or P atom, Y represents a cyclic structure bonded by a saturated bond or an unsaturated bond, and $R^2$ and $R^3$ each independently represent an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be substituted by a substituent; r is 0 or an integer from 3 to 12, o is 0 or an integer from 1 to 8, p is 0 or an integer from 1 to 4, and q is 0 or an integer from 1 to 3, and the binder resin is crosslinked with itself via a metal in the metal compound on the toner particles' surface.

2. The toner according to claim 1, wherein the metal in the metal compound is at least one metal selected from a group consisting of Al, Cr, Zn, and Zr.

3. The toner according to claim 1, wherein the binder resin has a hydroxyl value ranging from 10 mg KOH/g to 80 mg KOH/g.

4. The toner according to claim 1, wherein a content of the metal compound is in a range from 0.2 mass % to 4.0 mass % with respect to the toner particles.

5. The toner according to claim 1, wherein the metal compound is selected from compounds represented by the following formulas (2) to (4):

(2)

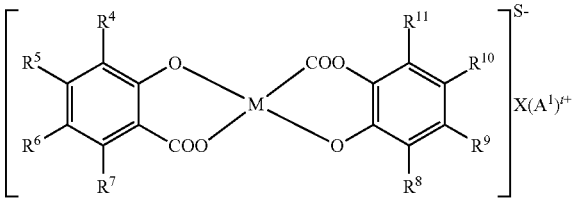

in formula (2), $R^4$ to $R^{11}$ each independently represents hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent, $R^4$ and $R^5$, or $R^5$ and $R^6$, or $R^6$ and $R^7$, or $R^8$ and $R^9$, or $R^9$ and $R^{10}$, or $R^{10}$ and $R^{11}$ may be bonded to form an aromatic ring, which may also have a substituent, M represents a metal selected from the group consisting of Al, Cr, Zn, and Zr;

s represents 0, 1, or 2;

t represents 1 or 2;

$(A^1)^{t+}$ represents $H^+$, $NH_4^+$, an alkali metal-based cation, an organic amine-based cation, or a quaternary organoammonium ion; and X represents 0, 1, or 2;

(3)

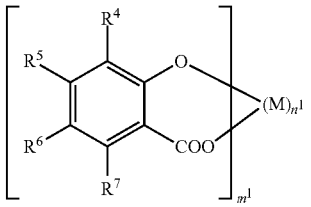

in formula (3), $R^4$ to $R^7$ each independently represent hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent, $R^4$ and $R^5$, or$R^5$ and $R^6$, or $R^6$ and $R^7$ may be bonded to form an aromatic ring, which may also have a substituent, M represents a metal selected from the group consisting of Al, Cr, Zn, and Zr;

$m^1$1 represents an integer greater than or equal to 3; and $n^2$ represents an integer greater than or equal to 1;

(4)

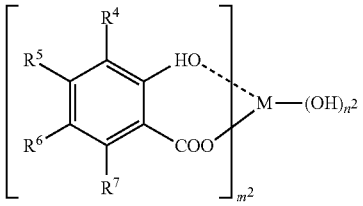

in formula (4), $R^4$ to $R^7$ each independently represents hydrogen, an alkyl group, aryl group, aralkyl group, cycloalkyl group, alkenyl group, alkoxyl group, aryloxy group, hydroxyl group, acyloxy group, alkoxycarbonyl group, aryloxycarbonyl group, acyl group, carboxyl group, halogen, nitro group, amino group, or carbamoyl group, wherein these may be additionally substituted by a substituent, $R^4$ and $R^5$, or $R^5$ and $R^6$, or $R^6$ and $R^7$ may be bonded to form an aromatic ring, which may also have a substituent, M represents a metal selected from the group consisting of Al, Cr, Zn, and Zr, and $m^2$ and $n^2$ each represent a positive integer.

* * * * *